US006139128A

United States Patent [19]

Magirl et al.

[11] Patent Number: 6,139,128

[45] Date of Patent: Oct. 31, 2000

[54] DISCRETE PEN WIPING AND PEN SPECIFIC PRINT DIRECTION TO REDUCE SIZE OF INKJET PRINTER

[75] Inventors: Christopher Sean Magirl; Kerry N. McKay; Junji Yamamoto; Kirkpatrick William Norton, all of San Diego, Calif.

[73] Assignee: Hewlett-Packard Company, Palo Alto, Calif.

[21] Appl. No.: 09/392,346

[22] Filed: Sep. 7, 1999

[51] Int. Cl.[7] ..... B41J 2/165

[52] U.S. Cl. ..... 347/22

[58] Field of Search ..... 347/22, 30–31, 347/23, 33, 29

[56] References Cited

U.S. PATENT DOCUMENTS

| | | | |
|---|---|---|---|
| 5,426,456 | 6/1995 | Kuelzer et al. | 347/30 |
| 5,749,662 | 5/1998 | Shibasaki et al. | 400/82 |
| 5,793,388 | 8/1998 | Martinson et al. | 347/19 |

*Primary Examiner*—N. Le
*Assistant Examiner*—Michael Nghiem

[57] ABSTRACT

An inkjet printer and method of printing to reduce printer footprint size using printhead service stations comprised of printhead wipers, priming and capping apparatus at each end of the path of travel of a printhead carriage having multiple printheads. Selected printheads are serviced in each service station and selected printheads may be used for printing in opposite directions to further reduce footprint size of the printer.

14 Claims, 3 Drawing Sheets

DISCRETE PEN WIPING AND PEN SPECIFIC PRINT DIRECTION TO REDUCE SIZE OF INKJET PRINTER

BACKGROUND OF THE INVENTION AND PRIOR ART

The present invention relates to the art of computer driven printers, particularly color inkjet printers of desktop size in which reduction of the footprint of the printer enables more efficient utilization of available space. Printers of this type have a printhead carriage which is mounted for reciprocal movement on the printer chassis in a direction orthogonal to the direction of movement of the paper or other medium on which printing is to take place through the printer. The printer carriage of a color printer typically has a black ink and one or more color thermal inkjet printheads removably mounted thereon and a printhead servicing station at one end of the path of carriage travel at which the printheads may be wiped, primed and capped during periods of non-use.

Printhead servicing stations have a finite width which is dictated primarily by the number of printheads to be serviced and the number of printhead servicing functions to be performed. The printhead servicing station may be designed with printhead wipers, caps and spittoons into which ink is ejected during printhead priming. The servicing elements may be mounted in stationary position on printer or, as is preferred, the servicing elements may be moveable on a sled or other support to the servicing position and moveable away from the servicing position to an access position where the servicing elements may be repaired or replaced. It will thus be appreciated by persons skilled in the art that elimination of one or more of these servicing functions at the service station enables the width of the service station to be reduced thus resulting in a printer of smaller size and footprint. In co-pending application Ser. No. 09/115,153 filed Jul. 14, 1998, entitled PRINTHEAD SERVICING TECHNIQUE by Glen Gaarder owned by the assignee of the present invention, reduction in the width of an inkjet printer from the traditional design in which all servicing elements are located at one end of the path of carriage travel is made by relocating the printhead capping function, which is not needed during printing, into the print zone of the printer.

OBJECT OF THE INVENTION

The primary object of the present invention is to provide further reductions in the overall width or footprint of an inkjet printer.

SUMMARY OF THE INVENTION

The present invention provides a method of printing and servicing at least two inkjet printheads in an inkjet printer comprising the steps of:

a) positioning a printhead carriage having at least two inkjet printheads thereon at a first end of a path of carriage movement;

b) accelerating said carriage and printheads from a first rest position in a first direction through a first acceleration zone to a print zone;

c) ejecting ink from at least one of said printheads to print as said carriage and printheads move in said first direction through said print zone;

d) wiping at least one of said printheads at a service station positioned at a second end of said path of carriage movement;

e) accelerating said carriage and printheads from a second rest position in a second direction through a second acceleration zone to said print zone;

f) ejecting ink from at least one of said printheads to print as said carriage and printheads move in said second direction through said print zone; and g) wiping at least one of said printheads at a second service station positioned at said first end of said path of carriage movement.

The present invention further provides, in an inkjet printer having a chassis, a printhead carriage moveable transversely of the chassis across a print zone during printing, at least a first and a second inkjet printhead mounted on the carriage and printhead servicing means on said chassis for servicing said printheads, the improvement wherein said printhead servicing means comprises separate servicing stations respectively comprised of a first printhead wiper in a first printhead wiping position laterally spaced from a first side of said print zone for wiping said first printhead and a second printhead wiper laterally spaced from a second side of said print zone for wiping said second printhead.

DESCRIPTION OF THE PREFERRED EMBODIMENT

Figure 1:
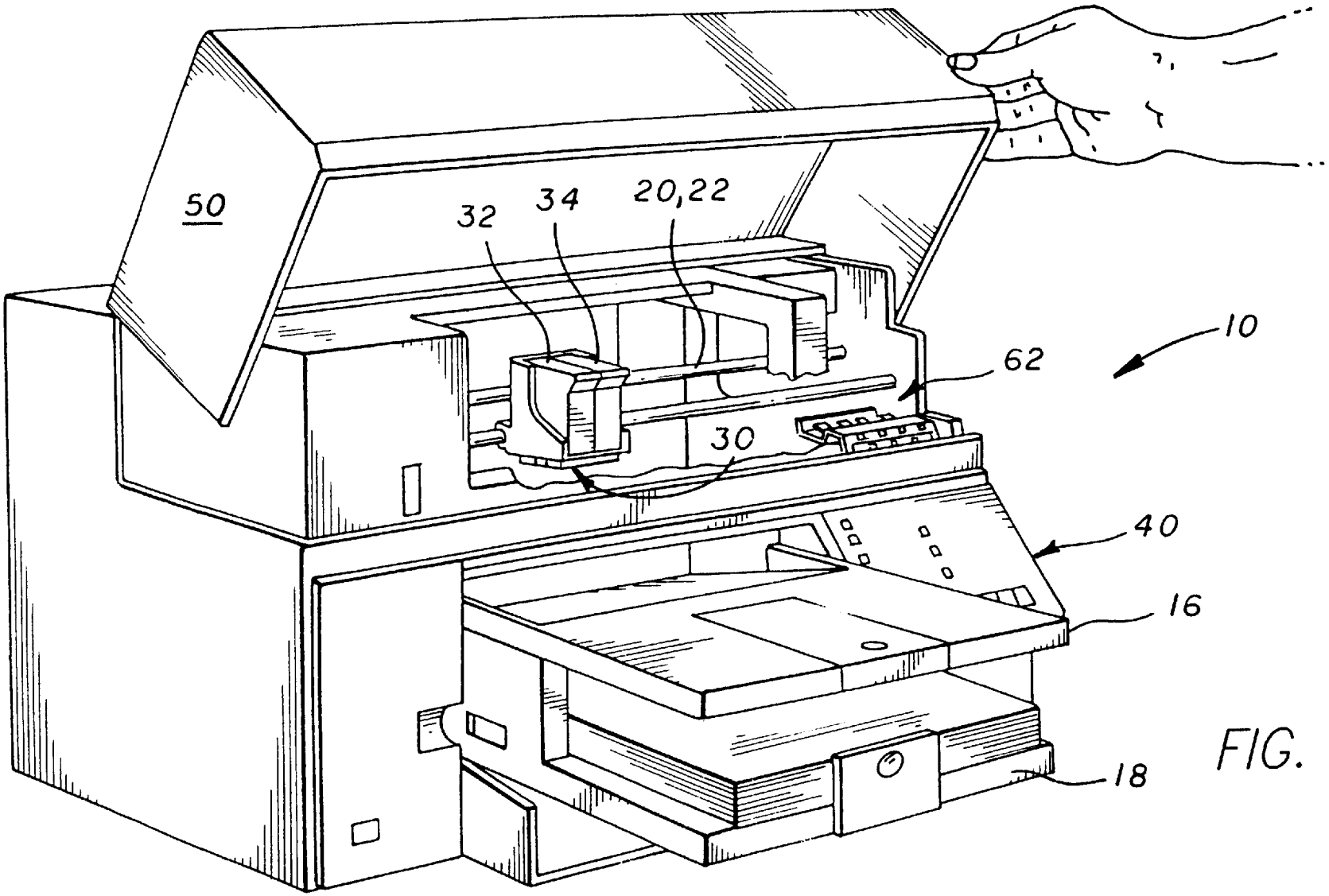
FIG. 1 is a perspective view of a desktop size inkjet printer.

The perspective view of FIG. 1 shows a desk top inkjet printer 10 having a chassis 12 on which a transversely extending carriage support or supports 20, 22 are mounted and a carriage 30 is slidably mounted on the support or supports for linear back and forth movement transversely of the printer 10. Two or more removable printheads 32, 34 are mounted on the carriage 30 and eject ink downwardly onto the media on which printing is to take place. The printer also may have an upper single sheet paper tray 16, a lower paper supply tray 18 for holding a stack of paper or other media on which printing is to take place, a control center 40, a print zone cover 50 and, pursuant to the invention, inkjet printhead servicing stations 60, 62 (only one of which is seen in FIG. 1) at each end of the print zone.

Figure 3:
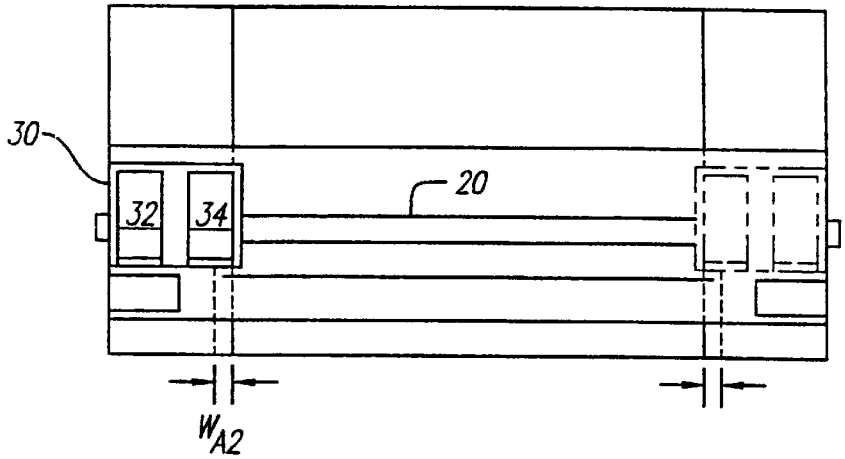
FIG. 3 is a schematic plan view of a two pen printer according to a first embodiment of the invention having printhead service stations at each side of the printer.
Figure 4:
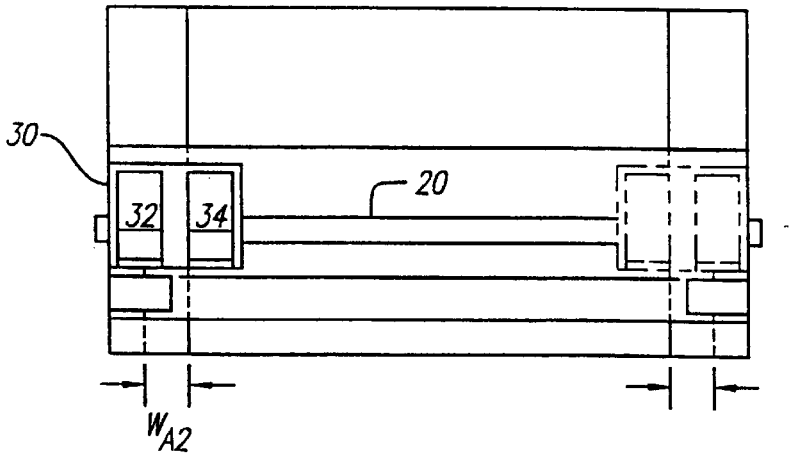
FIG. 4 is a schematic plan view of the printer of FIG. 3 further modified to incorporate pen specific printing.
Figure 5:
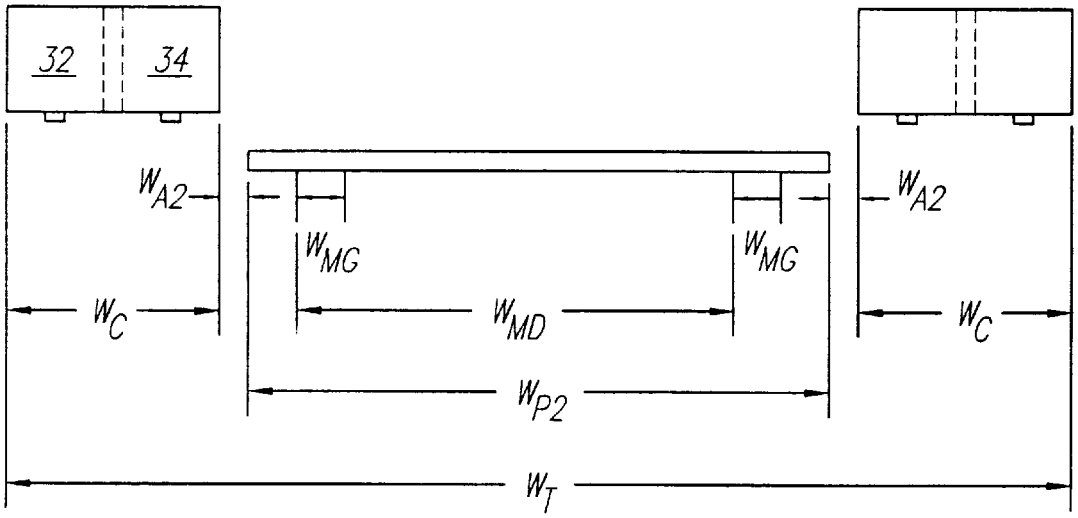
FIG. 5 is a schematic elevation view of the prior art printer of FIG. 2 showing distancing callouts therefor.

With reference to FIGS. 2–6, the total operational width $W_T$ of a printer is comprised of the sum of the width of the print zone ($W_{PZ}$) plus twice the width of the printer carriage ($2W_C$) plus the width of two printhead carriage acceleration zones ($2W_{AZ}$). The full width of the print zone $W_{PZ}$ is ordinarily not used during printing. As seen in FIG. 5, the paper or other media on which printing is to take place has a width $W_{MD}$ and, at each edge of the media, is usually left a margin $W_{MG}$ in which no printing occurs. Thus, the print zone has a width $W_{PZ}$ which is suitable for printing on media of different widths and accommodates margins of different widths which remain un-printed.

Also, as is well known to those skilled in the art, the printer carriage 30 having two or more separate printheads 32, 34 thereon must first accelerate from a terminal position at either end of the path of carriage travel to a substantially constant printing velocity before accurate printing without undue compensation for acceleration and deceleration of the printheads can take place. Accordingly, acceleration zones $W_{AZ}$ are depicted at each end of the print zone. Although the schematic drawings shown herein show only two printheads 32, 34 on the carriage 30 (typically the left hand printhead is black ink and the right hand printhead is color ink), the teachings of the invention are not limited to the embodiment shown for illustrative purposes since it is not unusual to mount four or more printheads containing ink of different colors side by side on the printhead carriage 30.

Figure 2:
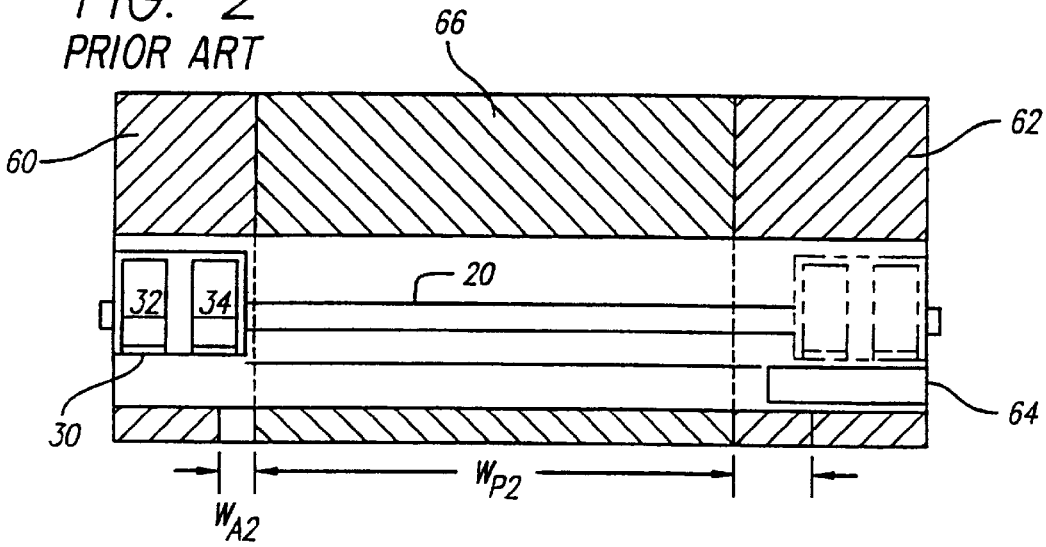
FIG. 2 PRIOR ART
FIG. 2 is a schematic plan view of a typical prior art printer architecture including a printhead carriage having two pens thereon and a service station at one side of the printer.

FIG. 2 schematically shows a conventional prior art printer in which all printhead servicing takes place at a printhead servicing station 62 located at the right side of the printer. Accordingly, since each printhead must be serviced in a single service station 62 containing multiple printhead servicing functions (schematically shown as 64) including wiping and priming functions through which the printheads must be moved, the right hand printhead overtravel zone (also depicted by 62) is somewhat longer than the left hand overtravel zone 60. The print zone is depicted by 66. The carriage overtravel zones 60, 62 are the zones occupied by the carriage at each side of the print zone and, if used for printhead servicing, are also referred to herein as servicing zones 60, 62. The width of the carriage overtravel zones is a critical part of proper functionality for an inkjet printer mechanism. Carriage overtravel permits the carriage 30 to decelerate, change direction and accelerate to the desired carriage velocity before ink drops are ejected onto the media. Ejection of ink drops while the carriage 30 and printheads 32, 34 accelerate or decelerate is undesirable due to the difficulty in accurately timing the exact moment when ejection or firing must occur to insure accurate dot placement during printing. The width of the carriage printhead service zone 62 as seen in the prior art arrangement illustrated in FIG. 2 is necessarily greater than the width of the carriage overtravel zone 60 at the left end of the path of carriage movement where no servicing takes place.

Figure 6:
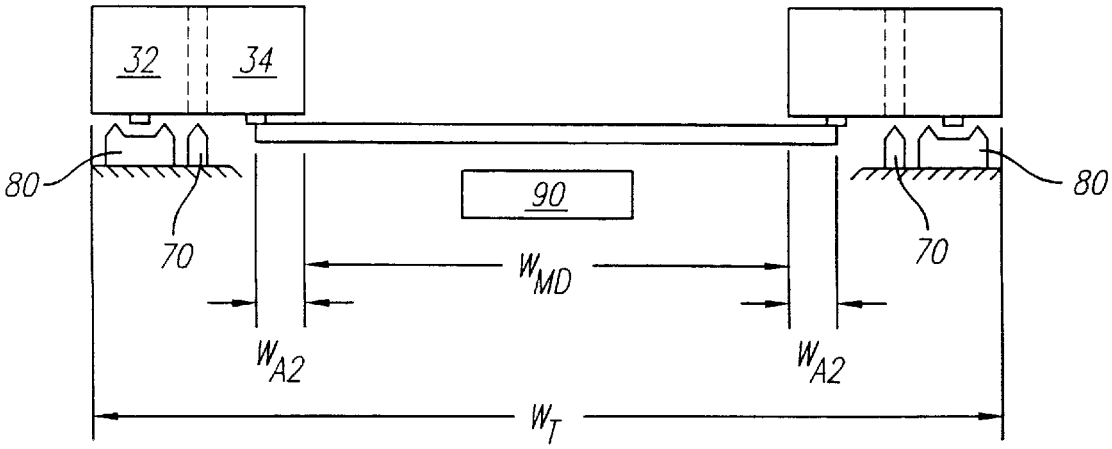
FIG. 6 is a schematic elevation view of the printer of FIG. 3 showing distancing callouts therefor.

As seen in FIGS. 3, 5 and 6 the total operational width $W_T$ of the printer 10 is reduced according to the present invention by the servicing selected printheads at separate printhead service stations 60, 62 at each end of the path of carriage travel. At each service station, one or more wipers 70, 72 for servicing a single printhead are provided in position to wipe the leading printhead or printheads on the carriage and printheads after printing has taken place. For example, the right hand wiper 72 (FIG. 6) wipes the leading or right hand (for example color) printhead 34 mounted on the right side of the printhead carriage 30 after printing in the left to right direction but does not wipe the other 32 (e.g., black) printhead. Conversely, the left hand wiper 70 wipes the leading (black) printhead 32 mounted on the left side of the printhead carriage after printing in the right to left direction has taken place. Thus, the width of the right side overtravel or servicing zone 62 is reduced as compared to the prior art zone 62 shown in FIG. 2 resulting in a reduction in total operational width $W_T$ of the printer since wiping of only the leading printhead (or printheads) takes place therein. The width of the left overtravel zone 60 is not increased by adding the servicing functions therein since only the leading printhead or printheads are service.

Each service station 60, 62 may also include a printhead capping and priming function 80 in addition to the wiping function. As is known to those skilled in the art, the capping function 80 may include a number of caps and spittoons equal in number to half of the number of printheads to be primed so that the individual printheads can be positioned over individual caps and spittoons whereby ink may be ejected or sucked from the printheads to enter the spittoons when priming the printheads. The details of the caps and spittoons and inkjet priming methods are not necessary to a full understanding of the invention described and claimed herein.

As seen in FIG. 4, a further reduction in the total operational width $W_T$ of the printer 10 can be accomplished by using the teachings set forth above with respect to the invention illustrated in FIGS. 3–6 together with the technique of printing with only the trailing one of the two printheads shown. For example, the left printhead 32 (e.g., black) is controlled to print only when the carriage and printheads travel to the right and the right (color) printhead 34 is controlled to print only when the carriage and printheads travel to the left. Here again it will be appreciated that the method of printing described with reference to FIG. 4 is not limited to printers having only two printheads. In its broadest aspects, if more than two printheads are provided, only the leading one or two printheads need to be deactivated when, for example, a carriage having four separate printheads mounted thereon is used, i.e., the trailing one or two printheads always accomplish the printing function while the leading one or two printheads are de-actuated, the reverse mode of operation being used when printing in the opposite direction takes place.

FIG. 6 also shows an optional centrally located printhead priming and capping station 90 in schematic form which is positioned in the print zone. The carriage 30 and associated printheads 32, 34 may be positioned over the central capping station 90 during period of non-operation of the printer so that the printheads can be primed, capped and protected from drying out, ingress of dirt and the like. As is known to those skilled in the art, the central capping station 90 may include a number of caps and spittoons equal in number to the number of printheads on the carriage 30 so that all printheads can be positioned over individual caps and spittoons.

It will be appreciated from the foregoing that the splitting of printhead wiping and priming functions into two service stations 60, 62, one at each side of the printer, and the printhead specific directional printing illustrated with reference to FIG. 4 each separately and significantly contribute to the reduction of the overall size and footprint of an inkjet printer by reduction of the total operational width $W_T$ through reduction of the size of the carriage overtravel zones.

Persons skilled in the art will appreciate that various modifications of the preferred embodiment described above can be made and, for this reason, the intended scope of protection is defined by the claims which follow.

What is claimed is:

1. A method of printing and servicing at least two inkjet printheads in an inkjet printer comprising the steps of:

a) positioning a printhead carriage having at least two inkjet printheads thereon at a first end of a path of carriage movement;

b) accelerating said carriage and printheads from a first rest position at said first end in a first direction through a first acceleration zone to a print zone;

c) ejecting ink from at least one of said printheads to print as said carriage and printheads move in said first direction through said print zone;

d) servicing at least one of said printheads at a first service station positioned at a second end of said path of carriage movement and bringing said carriage to rest at a second rest position at said second end of said path of carriage movement;

e) accelerating said carriage and printheads from a second rest position at said second end in a second direction through a second acceleration zone to said print zone;

f) ejecting ink from at least one of said printheads to print as said carriage and printheads move in said second direction through said print zone; and g) servicing at least one other of said printheads at a second service station positioned at said first end of said path of carriage movement.

2. The method of claim 1, wherein said path of carriage movement is linear.

3. The method of claim 2, wherein the leading printhead is serviced during movement of said carriage and printheads in said first and second directions after printing.

4. The method of claim 3, wherein said leading printhead is serviced at the associated service station by wiping and capping said printhead.

5. The method of claim 4, further comprising the steps of causing ink flow from said printhead to prime said printhead at said associated service station.

6. The method of claim 2, comprising the steps of deactivating a leading printhead and printing with a trailing printhead during printhead movement across said print zone.

7. In an inkjet printer having a chassis, a printhead carriage moveable transversely of the chassis across a print zone during printing, at least a first inkjet printhead and a second inkjet printhead mounted on the carriage, said first and said second printheads being spaced from each other in a carriage scan direction, and printhead servicing means on said chassis for servicing said printheads, the improvement wherein said printhead servicing means comprises separate servicing stations respectively comprised of a first printhead wiper in a first printhead wiping position laterally spaced from a first side of said print zone for wiping said first printhead and a second printhead wiper laterally spaced from a second side of said print zone opposite from said first side for wiping said second printhead.

8. The printer of claim 7, wherein a printhead acceleration zone is defined as the distance between the leading edge of the printhead nearest the print zone when said carriage is at the end of its path of travel and the nearest edge of the print zone, said printer having printhead acceleration zones at each end of the path of carriage travel of substantially equal length.

9. The printer of claim 8, wherein said printhead wipers are laterally spaced from said acceleration zones and are positioned on said chassis to wipe the operational width of the associated printhead as it moves to the end of its path of travel.

10. The printer of claim 9, further comprising printhead priming and capping apparatus in said servicing stations.

11. The printer of claim 7, further comprising printhead control means for deactivating a leading printhead and printing with a trailing printhead when the carriage moves in a first direction and for deactivating another leading printhead and printing with another trailing printhead when the carriage moves in a second direction opposite to said first direction.

12. The printer of claim 11, wherein a printhead acceleration zone is defined as the distance between the leading edge of the printhead farthest from the print zone when said carriage is at the end of its path of travel and the nearest edge of the print zone, said printer having printhead acceleration zones at each end of the path of carriage travel of substantially equal length.

13. The printer of claim 12, wherein said wipers are positioned in said acceleration zones.

14. The printer of claim 13, further comprising a printhead priming and capping apparatus in each of said servicing stations.

* * * * *

UNITED STATES PATENT AND TRADEMARK OFFICE

CERTIFICATE OF CORRECTION

PATENT NO. : 6,139,128
APPLICATION NO. : 09/392346
DATED : October 31, 2000
INVENTOR(S) : Magirl et al.

It is certified that error appears in the above-identified patent and that said Letters Patent is hereby corrected as shown below:

In the Claims

In claim 1, column 5, lines 9-10 the phrase "e) accelerating said carriage and printheads from a second rest position" should read as -- "e) accelerating said carriage and printheads from the second rest position" --.

Signed and Sealed this
Third Day of June, 2014

Michelle K. Lee

Michelle K. Lee
*Deputy Director of the United States Patent and Trademark Office*